United States Patent [19]

Al-Harari

[11] Patent Number: 4,502,689

[45] Date of Patent: Mar. 5, 1985

[54] APPARATUS AND METHOD FOR PLAYING A BOARD GAME

[76] Inventor: Wojih Y. Al-Harari, c/o Zaki Al-Harari, P.O. Box 1343, New York, N.Y. 10025

[21] Appl. No.: 534,972

[22] Filed: Sep. 22, 1983

[51] Int. Cl.[3] ..... A63F 3/00

[52] U.S. Cl. ..... 273/265

[58] Field of Search ..... 273/265, 274

[56] References Cited

U.S. PATENT DOCUMENTS

| | | | |
|---|---|---|---|
| 3,126,205 | 3/1964 | Jordan | 273/274 |
| 4,059,273 | 11/1977 | Kindred | 273/265 |
| 4,059,274 | 11/1977 | Samson | 273/265 |
| 4,059,275 | 11/1977 | Price | 273/265 |
| 4,147,358 | 4/1979 | Erickson | 273/241 |
| 4,188,036 | 2/1980 | Jones-Fenleigh | 273/265 |
| 4,241,923 | 12/1980 | Meirovitz | 273/265 |
| 4,272,081 | 6/1981 | Broom | 273/265 |
| 4,317,570 | 3/1982 | Brunton | 273/246 |
| 4,331,333 | 5/1982 | Willcocks | 273/238 |
| 4,343,474 | 8/1982 | Caney | 273/237 |
| 4,346,889 | 8/1982 | Barlow et al. | 273/1 GA |
| 4,348,027 | 9/1982 | Escamilla-Kelly | 273/241 |
| 4,364,568 | 12/1982 | Tracy | 273/242 |

FOREIGN PATENT DOCUMENTS

| | | | |
|---|---|---|---|
| 1009675 | 5/1977 | Canada | 273/265 |
| 1560473 | 2/1980 | United Kingdom | 273/265 |

*Primary Examiner*—Harland S. Skogquist

*Attorney, Agent, or Firm*—E. Robert Newman

[57] ABSTRACT

An apparatus and a method of playing a game in which a game board having a question indicator-grid and aligned response sections, for use in asking and responding to questions and answers by the placement of specialized pegs, the questions and answers relating to determining the opposing player's secretly selected ascending or descending numerical sequence.

10 Claims, 5 Drawing Figures

PLAYER 'A' – 2,4,4,5,9

PLAYER 'B' – 8,4,3,2,1

APPARATUS AND METHOD FOR PLAYING A BOARD GAME

TECHNICAL FIELD

The present invention relates generally to an apparatus and method of playing a board game, and more particularly to a game calling for the exercise of logical thinking and inductive reasoning on the part of the players. It is a board game in the sense that it uses a board and playing pieces to temporarily record moves and responses by the players. The object of the game is for each player to discover the digits in an opposing player's hidden sequence of digits using one section of the board to mark the attempts or questions and another section of the board to mark the corresponding responses, or answers, to the attempts.

BACKGROUND AND PRIOR ART

Most of the new games on the present-day market are short-lived when compared to some of the fundamental games that have been passed down through the ages. One reason may be that the newer games generally depend upon a specific optimal combination of moves to win, and once discovered, the game becomes boringly redundant. For example, a recent game that has become a short-lived "fad" is Rubick's Cube. Those people that have learned the proper sequence of moves to arrange the various colors become bored because the "challenge" is gone—all that is left is to be able to perform the sequence of moves more quickly.

Those games that have lasted throughout a long period of time have offered something more than mere repetition as the basis for winning. Their real essence is in the fact that every time the game is played a different sequence of moves occurs to win the game. Examples are plentiful, from the simplicity of checkers and dominoes, to the complexity of chess. Although even these games have various repeated sequences which give one player an advantage over the other, the lifeblood is in the fact that there are many variations in the combinations of such sequences—sometimes called strategy—and no specific strategy will always win the game. Such games become "educational" in that they develop a player's logical thinking, inductive reasoning and analytical foresight as he anticipates his opponent's moves and strategies.

SUMMARY OF THE INVENTION

It is an object of the present invention to provide an enjoyable method of improving skills in logic, inductive reasoning, and analytical thought processes.

Another object is to provide an apparatus and method of playing a board game which is easy to learn, yet provides sufficient complexity to appeal to a broad range of persons.

A further object of the invention is to provide a game wherein the sequence of play may be varied within a constant grid to provide a plurality of distinct playing patterns and strategies.

Yet another object of the present invention is to provide a game wherein the method of play may be altered slightly to provide additional complexity as the players acquire expertise.

More generally, an object of the invention is to provide an apparatus and method of playing a game involving a game board upon which playing pieces are positioned to indicate specific numerals being "asked" by one player, in an attempt to discover an opponent's secret sequence of digits, and upon which different distinct playing pieces are positioned to indicate specific responses to such attempts. The game board has a constant grid within which playing pieces are positioned, such position identifying a specific row and column of the grid and thereby a numeral designating each row and column. The two numerals identified in this fashion are attempts to discover the opponent's predetermined sequence of digits, and the opposing player must respond to each such attempt by positioning a different and distinct playing piece in a separate response section of the game board. The response is given in a row and column of the response section corresponding to the location of the opposing player's playing piece in making his attempt. Players alternate attempting and responding until one player discovers the numerals and sequence in the other player's secret sequence of digits.

These and other objects, advantages, and novel features of the present invention will become apparent from the following detailed description of the invention when considered in conjunction with the accompanying drawings.

DESCRIPTION OF THE PREFERRED EMBODIMENTS

Figure 2:
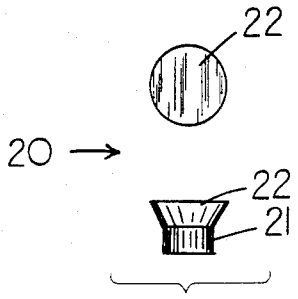
FIG. 2 is an enlarged elevational and top view of one game piece of the invention.
Figure 3:
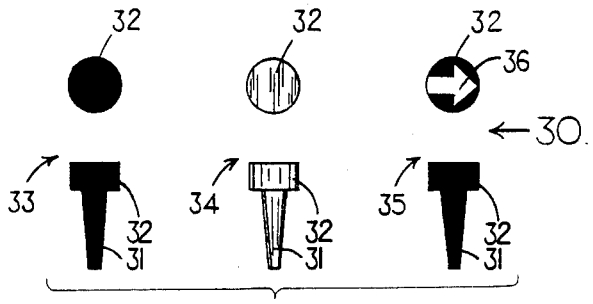
FIG. 3 is an enlarged elevational and top view of three other game pieces, each individually identifiable.
Figure 1:
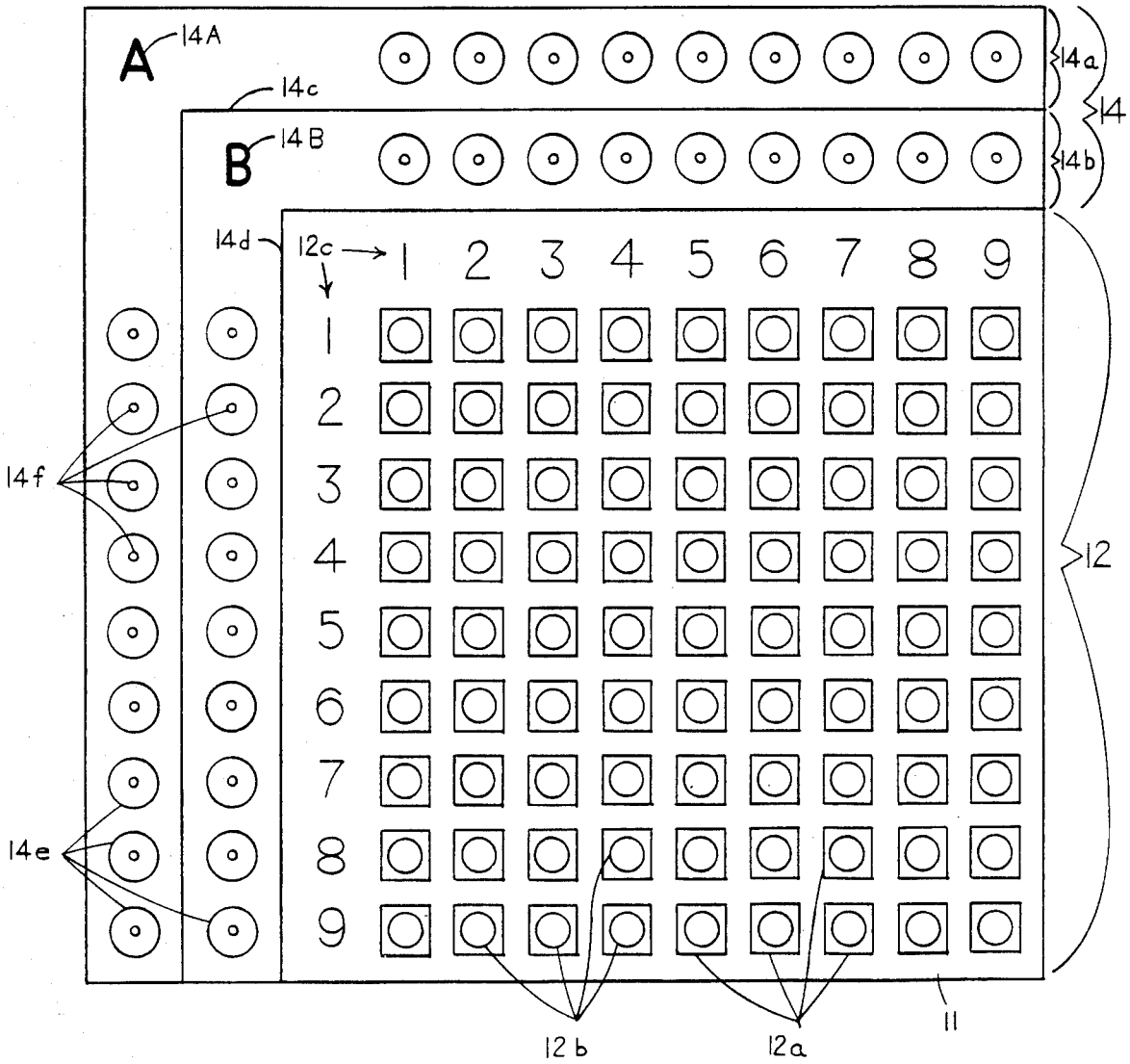
FIG. 1 is a top view of the board of the invention.

Referring now to the drawings, wherein like reference numerals designate identical or corresponding parts throughout the several views, and more particularly to FIGS. 1, 2 and 3, whereon the invention is designated generally at (10), its major components are a game board (11), a plurality of markers (20), and a plurality of pegs (30).

Referring now specifically to FIG. 1, the game board (11) is a substantially square piece of rigid material having a question indicating section (12) and a response indicating section (14) marked on its upper surface. The question indicating section (12) occupies a majority of the board (11) and extends to its lower and right edges. The questioning section (12) has nine rows and nine columns of congruent squares (12*a*) marked therewithin. A shallow depression (12*b*), having a diameter slightly less than the length of a side of a square (12*a*), is entered within each of the squares (12*a*) for removably receiving a marker (20) (to be fully described in a following section). To complete the question indicating section (12), numerals (12*c*) are centered within a narrow band located adjacent to the left and upper boundaries of the questioning section (12) and aligned with each row and each column of the squares (12*a*). The numerals are drawn in ascending order beginning with the number "one" abutting the first row and the same numnber abutting the first column of the questioning section squares (12*a*), whereby each row and column of questioning section squares (12*a*) is given a designated number.

Continuing to refer to FIG. 1, the response section (14) is comprised of two narrow bands (14*a*) and (14*b*) located between the left and upper boundaries of the questioning section (12) and the left and upper edges of the board (11). The outermost responding section (14*a*), adjacent the edges of the game board (11), has an enclosure line (14*c*) delineating its inner boundary and is designated as one player's responding section by a letter "A" (14A) drawn in its upper left corner. The other response section (14*b*) has an enclosure line (14*d*) delineating its inner boundary and is designated as the other player's response section by a letter "B" (14B) in its upper left corner. A circle (14*e*) is centered in each band of the response section (14*a*) and (14*b*) and aligned with each row and each column of the questioning section squares (12*a*), each said circle (14*e*) having a diameter approximately equal to the length of a side of the questioning section squares (12*a*). Centered in each of these circles (14*e*) is a small hole (14*f*) for removably receiving a peg (30) (to be fully described in a following section).

Referring now to FIG. 2, the markers (20) are comprised of two portions, a lower portion (21) and an upper portion (22). The lower portion (21) is in the shape of a shallow cylinder and the upper portion (22) is in the shape of an inverted truncated cone, its lower surface having the same diameter as the lower portion (21) and affixed thereto at that surface. The diameter of the lower portion (21) of markers (20) is slightly smaller than that of the shallow depressions (12*b*) in order that the markers (20) may be removably inserted therewithin as the game is played.

Referring now to FIG. 3, the pegs (30) are comprised of two portions, a lower portion (31) and an upper portion (32). The lower portion (31) is in the shape of an inverted tapered cylinder and the upper portion (32) is in the shape of a shallow cylinder, its lower surface having a diameter larger than the upper surface of the lower portion (31) and affixed thereto, at that surface. The upper and lower diameters of the lower portion (31) are larger and smaller, respectively, than the diameter of the holes (14*f*) in order that the pegs (30) may be removably inserted therewithin as the game is played.

The pegs (30) are of three types. A plurality of pegs (33) are colored black for indicating an affirmative answer, a plurality of pegs (34) are colored white for indicating a negative answer, and four special arrow pegs (35) are black and have a white arrow (36) on their upper surface for indicating a special answer, the latter to be explained more fully in the description of the play of the game.

In one method of playing the game, it is played as a match which is comprised of two or more "games". Two persons play and each "game" proceeds as follows. First it is agreed between the players which player will set the length of a sequence of digits, which each player will secretly determine. The maximum sequence length is one less than the total number of rows and columns. It should be noted that the game could be played with a game board having a lesser or greater number of rows and columns than nine, and in such case the maximum sequence length would differ accordingly. In the same method of the game, the selected sequence must be in either ascending or descending order and each digit may be repeated one time. A simpler version of the game would be to restrict the order to either ascending or descending, but not a choice of either.

Once the sequence length has been set and each player has secretly selected his sequence, the game proceeds by the players asking each other certain restricted questions by means of a special code. These questions, as they are asked, must be answered, (truthfully, of course) first by the inquiring player and then by his opponent. The player who decides the sequence length will always be the one who asks the first question, when he sets that length at an odd number. If he sets the length at an even number, his opponent asks first. Since being the first player to ask a question is an advantage, he is called the "controlling" player and earns one point on winning the game; but if the opposing player wins, the opposing player receives two points. The match is won by the first player to win a total of three points.

Figure 4:
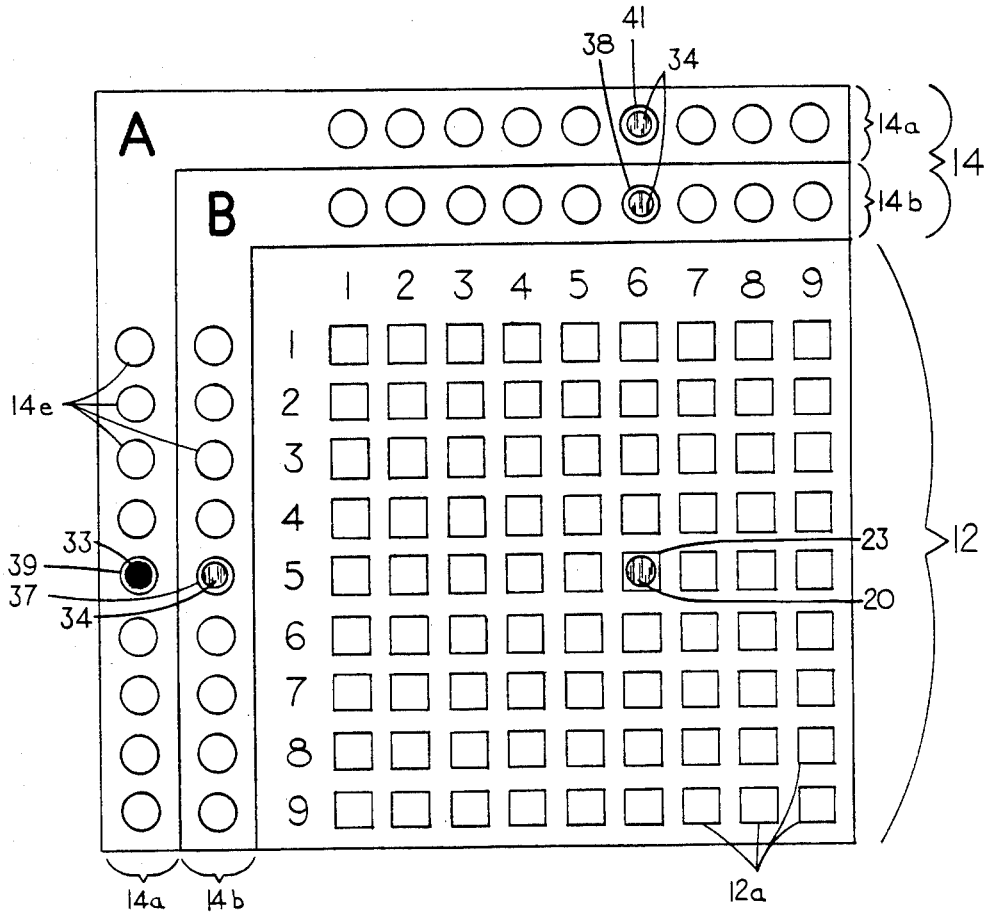
FIG. 4 is a top view of the invention during play.

For ease in explaining the remaining steps in playing each "game", a hypothetical game will be described. Referring now to FIG. 4, assume player B has made the decision that there will be five digits in the secret selected sequences. Assume further that player A has picked the sequence "2, 4, 4, 5, 9" and player B has chosen the sequence "8, 4, 3, 2, 1". Since player B has decided that the length of the secret sequences will have an odd number of digits, he will ask the first question and will score only one point if he wins. Each question must be whether either of any two digits are in the other player's secret sequence. Assume player B wants to ask "5" and "6". The code for asking this question is for player B to place a marker (20) in the questioning section square (12*a*) which is at the intersection of row "5" and column "6". Player B would therefore place a marker (20) in the questioning section square (12*a*) located at point (23). Before player B's move is finished he must also "answer" his own question by placing the appropriate pegs (30) in the corresponding circles (14*e*) of his own response section (14*b*). Therefore, he would place two white "no" pegs (34), one in the row (point 37) and one in the column (point 38) which intersect at point (23). White pegs were used since neither "5" nor "6" is a digit in his own secret sequence.

Player A must now respond to player B's question by placing the appropriate pegs (30) in his own response section (14*a*) in a corresponding manner. Since player A has a "5" in his secret sequence, he must place a black "yes" peg (33) in his response section (14*a*) in the same row as player B's marker (20) (which is indicated at point 39). Player A would also place a white "no" peg (34) in his response section (14*a*) in line with column 6 of the questioning section (12) (at point 41), that digit not being in his secret sequence.

Figure 5:
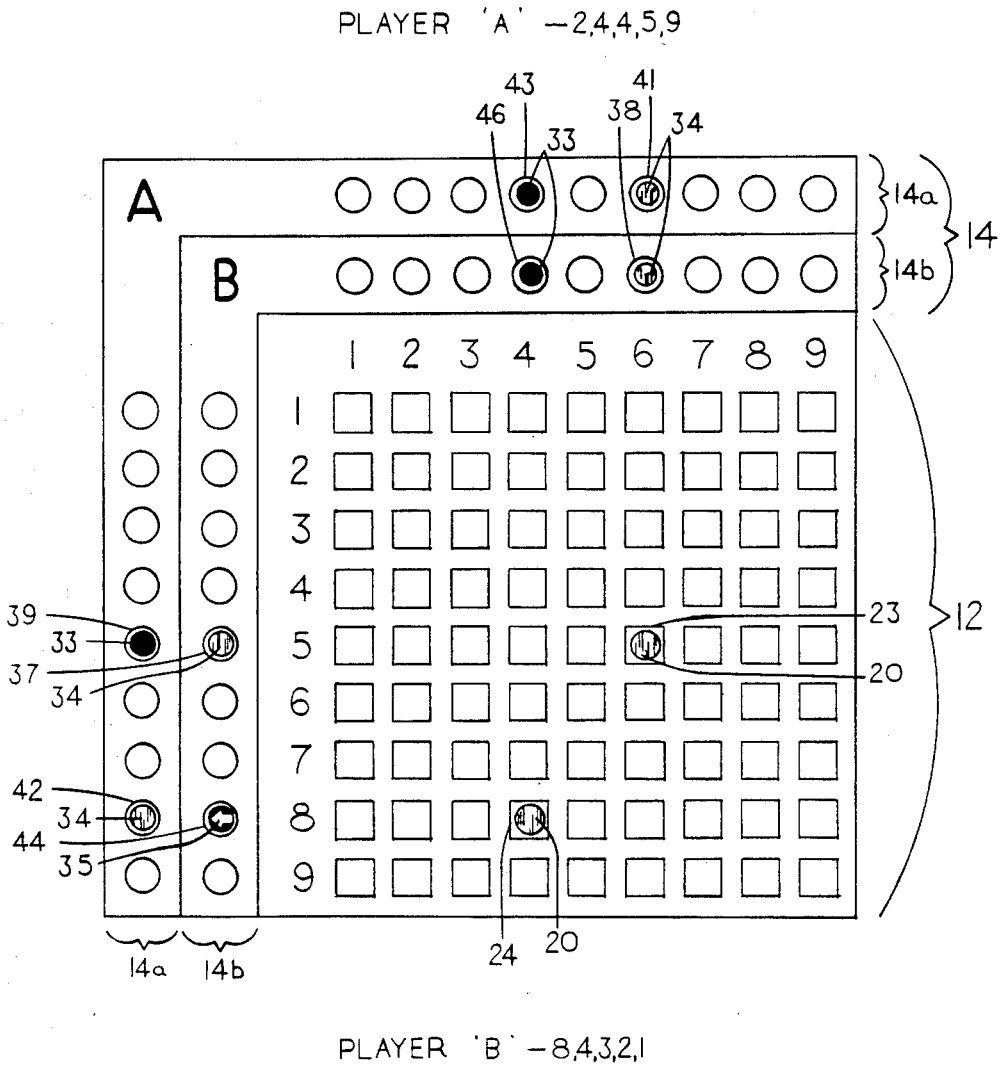
FIG. 5 is a top view of the invention during play at a later phase than that of FIG. 4.

Player A must now ask a question of player B by placing a marker (20) in the questioning section (12) in the same manner as player B's previous move. Referring now to FIG. 5 and assuming player A chooses to ask the digits "8"0 and "4", he would place a marker (20) in row 8, column 4 of the questioning section (12) (at point 24). Again, player A must "answer" his own "question" before player B must respond. Therefore, player A would put a white "no" peg (34) in row 8 of his response section (14*a*) (at point 42), and a black "yes" peg (33) in column 4, (at point 43).

Still referring to FIG. 5, player B must then respond to player A's question with the appropriate pegs (30). Because one of the digits asked was the first digit in player B's own secret sequence, he must use a special arrow peg (35). The arrow peg (35) is used whenever a digit asked is either the first or last digit of the secret sequence. Therefore, player B must place an arrow peg (35) in row 8 (at point 44) in his response section (14*b*) with the arrow pointing in the direction of the rest of the digits in the secret sequence (from player A's point of view). Since "8" is the first digit of the secret sequence the arrow must point to player A's right—towards the digits following in the sequence. Player B would also place a black "yes" peg (31) at point (46) in his response section (14*b*) in response to the other digit asked by player A.

This exchange of questions and responses continues until one player is able to discover the opposing player's secret sequence, thereby winning that "game". Thus, for every question by a player, four response pegs (30) will be positioned (two by each player).

The preferred method of playing the game is the same as just described, except that any time during the game the controlling player is permitted to elect to have each player add an additional digit to his own secret sequence. Thereafter, the opposing player becomes the controlling player and will score only one point if he wins. Then the new controlling player will have the same option to add an additional digit. However, a digit may not be added if either player must repeat a numeral more than once in order to add a number, or the sequence is already at its maximum length.

In another method of playing the game, it is played by two persons, but only one will choose a secret sequence while the other attempts to discover it, requiring the use of only one response section. This method is helpful when first learning to play, as the preferred method may be difficult for beginners or young children. The object is to determine the sequence of digits with the fewest questions. This method also requires the number of digits in the secret number to be revealed to the questioning player. At the end of each game the players exchange sections, attempting to improve their techniques and strategies. Each player's score may be evaluated based on the number of moves required to determine the secret number. This is accomplished by first counting the number of digits in the secret sequence. If there are an even number of digits then that number is divided by two, producing a "raw score". If there are an odd number of digits then one is first added to the number, and the total then divided by two, producing the "raw score". For example: if the secret sequence has 6 digits, then 6 is divided by 2, giving a raw score of 3. If the secret sequence has 7 digits, then the raw score is $7+1$ divided by two, or 4. If the player has revealed the secret sequence in the same number of questions as the "raw score", the evaluation is "excellent". If the player has revealed the secret sequence in one move more than the raw score, the evaluation is "good". If the player reveals the secret sequence in two or more questions greater than the raw score, the player "needs improvement and more concentration".

In yet another method of playing the game in which one player uses only the questioning section (12) and the other uses only the response section (14), the digits of the secret sequence may not be repeated, and the summation of the digits, as well as the number of digits in the sequence, must be revealed to the questioner. In this method the maximum length of the secret sequence is one less than the total number of rows or columns. The same "evaluation" schedule of the previous embodiment may be used.

It will be readily understood that the particular disposition or arrangement or nature of the elements of the invention are not of the essence of the invention, and that many variations, substitutions, and modifications may be made in departure from the particular construction and characterization in the drawings and foregoing description, without departing from the true spirit of the invention. It is therefore to be understood that the invention should be limited only by the breadth and scope of the appended claims.

What I claim is:

1. A method of playing a game in which a sequence of characters is selected by a first player and determined by a second player, comprising the steps of:

selecting an ascending or descending sequence of characters, by said first player, of a predetermined maximum length from a predetermined range of characters, the length of said sequence being less than the length of said range;

communicating said selected length by said first player to said second player;

initiating an attempt, by said second player, to determine said sequence of characters by communicating to said first player a pair of characters from said range;

communicating by said first player to said second player whether each of said pair of characters is included in said sequence and whether either begins or ends said sequence; and continuing said attempt by repeating the next preceding two steps until said second player determines said selected sequence of characters.

2. A method of playing a game as set forth in claim 1, wherein said characters are whole numbers.

3. A method of playing a game as set forth in claim 1, wherein said selected sequence of characters may have one repetition of any specific character.

4. A method of playing a game as set forth in claim 1, further comprising the step of:

communicating the summation of said sequence of whole numbers by said first player to said second player at the same time as said selected length is communicated.

5. A method of playing a game as set forth in claim 1, further comprising the steps of:

evaluating a player's performance by comparing the number of attempts needed to determine said sequence to a standard which is determined as follows:

dividing the number of characters in the sequence by two;

rounding the quotient of said division to the next larger whole number, said result being identified as the "raw score";

evaluating a number of attempts equal to the raw score as "excellent";

evaluating a number of attempts equal to one more than the raw score as "good"; and evaluating a number of attempts equal to two or more than the raw score as "needs improvement".

6. A method of playing a game for two players in which a sequence of characters is selected by each player and determined by the other player, comprising the steps of:

choosing which player will determine the length of said sequences of characters, said length to be less than a predetermined range;

communicating, by said chosen player, to the opposing player, what the length of said sequences is to be;

selecting an ascending or descending sequence of characters from a predetermined range of characters, by each player, of the length determined by said chosen player;

initiating an attempt, by said chosen player, if the number of characters in said sequences is odd (or, if the number of characters in said sequences is even, the roles of each said player, beginning with this step and throughout all subsequent steps, are reversed), to determine said sequence of characters selected by said opposing player by communicating to said opposing player a pair of characters from said range;

communicating by said chosen player to said opposing player whether each of said pair of characters is included in said chosen player's sequence and whether either character begins or ends the sequence;

communicating by said opposing player to said chosen player whether each of said chosen player's communicated pair of characters is included in said opposing player's sequence and whether either character begins or ends the sequence;

initiating an attempt, by said opposing player, to determine said sequence selected by said chosen player by communicating to said chosen player a pair of characters from said range;

communicating by said opposing player to said chosen player whether each of said pair of characters is included in said opposing player's sequence and whether either character begins or ends the sequence;

communicating by said chosen player to said opposing player whether each of said opposing player's communicated pair of characters is included in said chosen player's sequence and whether either character begins or ends the sequence; and continuing said attempts by each player by repeating the next preceding six steps until one of said players determines the selected sequence of characters of the other player.

7. A method of playing a game as set forth in claim 6, further comprising the steps of:

communicating by a controlling player whenever, and at his option, said sequence is less than its maximum length—said controlling player being the chosen player when said chosen player determines an odd number of characters in said sequences and said controlling player being the opposing player when said chosen player determines an even number of characters in said sequences—that a new character is to be added to each said sequence of characters;

selecting a new character by each said player from said predetermined range;

communicating by a new controlling player whenever, and at his option, said sequence is less than its maximum length—said new controlling player being the old said opposing player—that another new character is to be added to each said sequence of characters; and repeating next preceding three steps at any time before a selected sequence is determined by a player.

8. A method of playing a game as set forth in claim 7, wherein said characters are whole numbers.

9. A method of playing a game as set forth in claim 7, wherein said selected sequence of characters may have one repetition of any specific character.

10. A method of playing a game as set forth in claim 7, further comprising the steps of:

awarding one point to the final controlling player if he wins and two points to the other player if he wins; and playing a match comprised of additional games until one player wins by achieving a total of three points.

* * * * *